US006603437B2

(12) United States Patent
Chang

(10) Patent No.: US 6,603,437 B2
(45) Date of Patent: Aug. 5, 2003

(54) HIGH EFFICIENCY LOW SIDELOBE DUAL REFLECTOR ANTENNA

(75) Inventor: Yueh-Chi Chang, Northborough, MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/918,864

(22) Filed: Jul. 31, 2001

(65) Prior Publication Data

US 2002/0109644 A1 Aug. 15, 2002

Related U.S. Application Data

(60) Provisional application No. 60/268,354, filed on Feb. 13, 2001.

(51) Int. Cl.[7] ..... H01Q 13/00

(52) U.S. Cl. ..... 343/781 CA; 343/781 P

(58) Field of Search ..... 343/781 CA, 781 P, 343/779, 836, 837, 912; H01Q 13/00

(56) References Cited

U.S. PATENT DOCUMENTS

| | | | | | |
|---|---|---|---|---|---|
| 3,568,204 | A | * | 3/1971 | Blaisdell | 343/725 |
| 3,916,417 | A | * | 10/1975 | Wong et al. | 342/380 |
| 4,186,402 | A | | 1/1980 | Mizusawa et al. | 343/781 CA |
| 4,298,877 | A | | 11/1981 | Sletten | 343/781 CA |
| 4,334,780 | A | * | 6/1982 | Pernick | 356/446 |
| 4,360,815 | A | | 11/1982 | Mizuguchi et al. | 343/781 CA |
| 4,364,052 | A | | 12/1982 | Ohm | 343/781 CA |
| 4,618,866 | A | | 10/1986 | Makino et al. | 343/779 |
| 4,627,732 | A | * | 12/1986 | Braun et al. | 356/467 |
| 4,628,321 | A | | 12/1986 | Martin | 343/379 |
| 4,783,664 | A | * | 11/1988 | Karikomi et al. | 343/781 CA |
| 5,341,150 | A | * | 8/1994 | Joy | 343/912 |
| 5,459,475 | A | * | 10/1995 | Shen et al. | 343/781 P |
| 5,581,267 | A | | 12/1996 | Matsui et al. | 343/837 |
| 5,859,619 | A | * | 1/1999 | Wu et al. | 343/781 CA |
| 5,959,590 | A | * | 9/1999 | Sanford et al. | 343/781 CA |
| 5,973,652 | A | * | 10/1999 | Sanford et al. | 343/781 P |
| 5,977,923 | A | * | 11/1999 | Contu et al. | 343/761 |
| 6,043,788 | A | | 3/2000 | Seavey | 343/781 CA |
| 6,204,822 | B1 | * | 3/2001 | Cardiasmenos et al. | |
| 6,211,834 | B1 | * | 4/2001 | Durham et al. | 343/781 P |
| 6,295,034 | B1 | * | 9/2001 | Brown et al. | 343/781 CA |

FOREIGN PATENT DOCUMENTS

| | | | | |
|---|---|---|---|---|
| EP | 0 284 897 | | 10/1988 | H01Q/19/02 |
| EP | 0346105 A2 | * | 12/1989 | H01Q/19/19 |

OTHER PUBLICATIONS

The Microwave Journal; Jul. 1965; pp. 182–184.

Per–Simon Kildal; "Synthesis of Multireflector Antennas by Kinematic and Dynamic Ray Tracing"; IEEE Transactions on Antennas and Propagation; vol. 38, No. 10; Oct. 1990; pp. 1587–1599.

Yueh–Chi Chang et al.; "Synthesis and Analysis of Shaped Ade Reflectors by Ray Tracing"; IEEE 1995; pp. 1182–1185.

Kildal, Per–Simon, Synthesis of Offset Dual–Reflector Antennas by Solving Linear Equations, Antennas and Propagation Society International Symposium 1988, XP 10073278, Syracuse, NY, USA, Jun. 06–10, 1988, vol. 1, No., pp. 136–139.

* cited by examiner

*Primary Examiner*—Don Wong
*Assistant Examiner*—Trinh Vo Dinh
(74) *Attorney, Agent, or Firm*—Daly, Crowley & Mofford, LLP.

(57) ABSTRACT

A dual reflector antenna system includes a subreflector and a main reflector with optimized shapes defined from a desired field distribution pattern and a feed pattern. The reflector shapes capture maximum energy from the feed and allow sidelobes to closely track a predetermined sidelobe envelope for optimal overall antenna efficiency.

16 Claims, 7 Drawing Sheets

HIGH EFFICIENCY LOW SIDELOBE DUAL REFLECTOR ANTENNA

CROSS REFERENCE TO RELATED APPLICATIONS

This application claims the benefit of U.S. Provisional Patent Application No. 60/268,354, filed on Feb. 13, 2001, which is incorporated herein by reference.

STATEMENT REGARDING FEDERALLY SPONSORED RESEARCH

Not Applicable.

FIELD OF THE INVENTION

The present invention relates generally to antennas and, more particularly, to reflector antennas.

BACKGROUND OF THE INVENTION

Conventional reflector antenna designs require a tradeoff between high efficiency and low sidelobes. In general, the aperture illumination is tapered to minimize near in sidelobes. A −15 dB edge taper from the peak is a typical aperture distribution to minimize sidelobes adjacent to the main beam. However, tapering the aperture distribution reduces the illumination efficiency of the antenna aperture. For example, a −15 dB taper can reduce the aperture efficiency by about 25 percent and result in a 1.2 dB loss in antenna gain.

FIG. 1 shows a prior art reflector antenna 10 having a main reflector 12 that reflects energy from the feed 14. Far-out sidelobes due to so-called spillover energy 16, which exits the feed 14 but does not reach the reflector 12, and so-called edge diffraction 18, must also be taken into account.

One prior art attempt shapes a subreflector to redistribute a high taper feed pattern to almost uniform distribution on the main reflector aperture. However, with such a main reflector distribution, the near-in sidelobes are typically too high to meet standard commercial sidelobe requirements, e.g., 29–25 $\log_{10}(\theta)$ dBi, where $\theta$ is the angle from antenna boresight.

Another attempt to provide low sidelobes and high efficiency includes synthesizing dual-shaped reflectors to produce aperture power distribution defined by 1-(1-taper)(r/a) **2, where taper is the amplitude taper, r is the radial variable, and a is the main reflector radius. This arrangement does not provide low near-in sidelobes without relatively low illumination efficiency.

It would, therefore, be desirable to provide a reflector antenna system that provides relatively low near-in and far-out sidelobes and high aperture efficiency.

SUMMARY OF THE INVENTION

The present invention provides an antenna system having a main reflector and a subreflector having geometries that optimize antenna efficiency. While the invention is primarily shown and described in conjunction with a truncated Gaussian distribution over a circular aperture, it is understood that the invention is applicable to other antenna shapes and configurations.

In one aspect of the invention, a method for synthesizing a dual reflector antenna includes selecting certain parameters for the antenna such as reflector size, feed location, sub reflector midpoint location, main reflector midpoint location, and synthesis interval. The method further includes mapping energy from a known feed pattern to a selected analytical aperture distribution. From the initial locations of the feed and reflector midpoints, the shapes of the main and sub reflectors are synthesized using wavefront parameters to determine surface normals for each surface point. The resultant reflector shapes are adjusted as necessary to correct an computational errors.

The actual aperture field distribution is modified from the initial truncated Gaussian field distribution, for example, for the final synthesis of the shaped reflectors to allow the near in sidelobes to bump against a predetermined sidelobe requirement for optimizing overall antenna efficiency.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1:
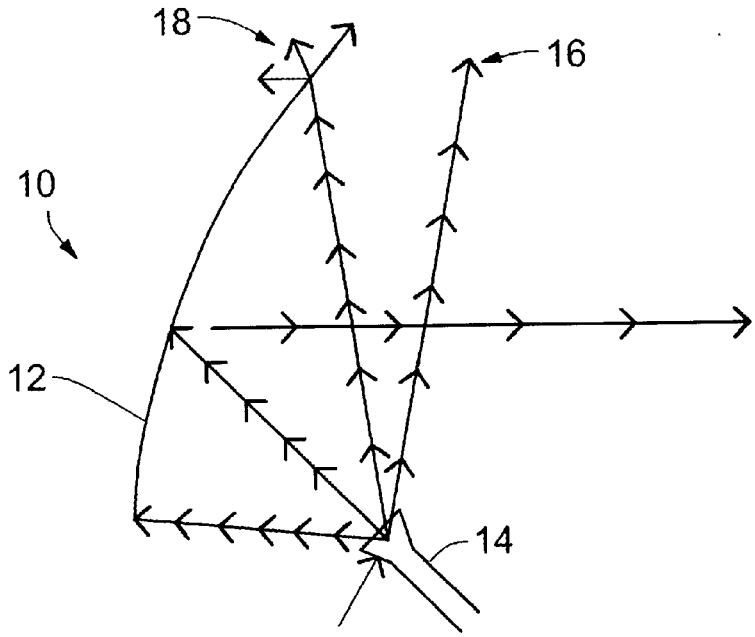
FIG. 1 (PRIOR ART)
FIG. 1 is a diagrammatic illustration of a prior art reflector antenna system.
Figure 2:
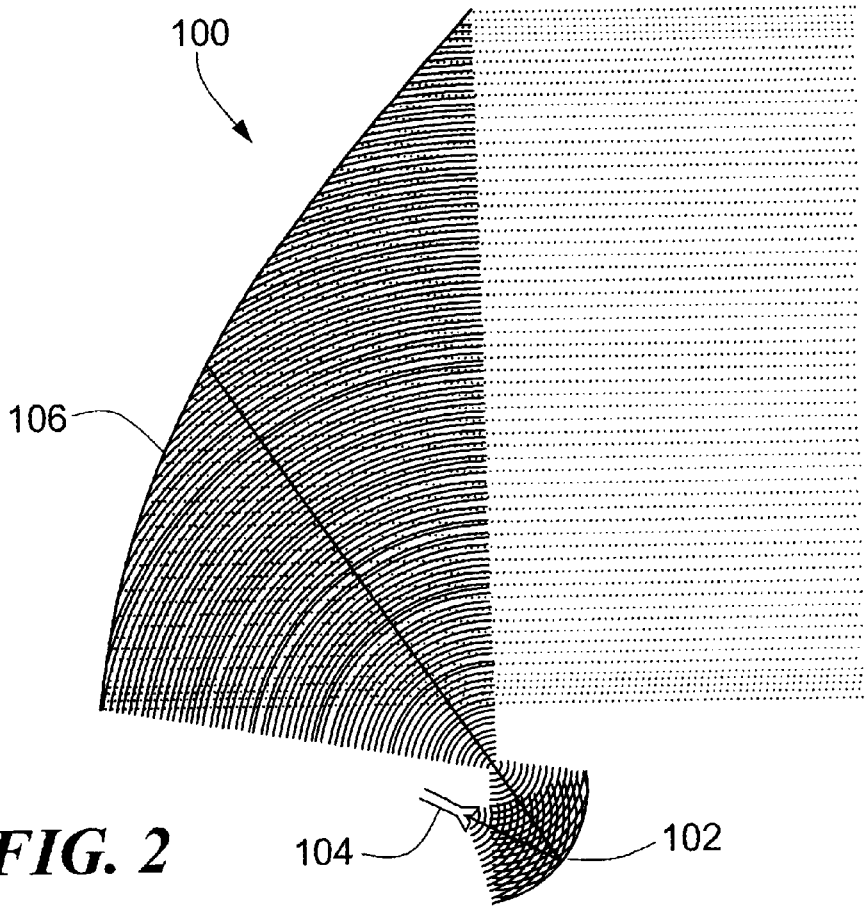
FIG. 2 is a side view of a shaped dual reflector antenna system in accordance with the present invention.

FIG. 2 shows a dual reflector antenna system 100 having high antenna efficiency and low sidelobes in accordance with the present invention. The antenna system 100 includes a subreflector 102 that reflects energy from a feed 104 to a main reflector 106. The main reflector 106 provides an antenna beam for transmission from the antenna system 100.

Figure 3:
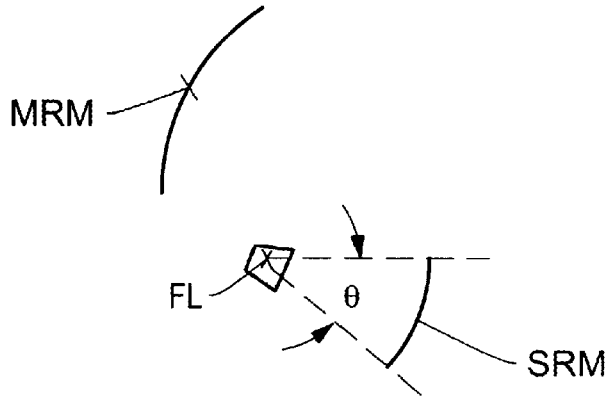
FIG. 3 is a schematic depiction of the antenna system of FIG. 2 showing a feed angle.
Figure 4:
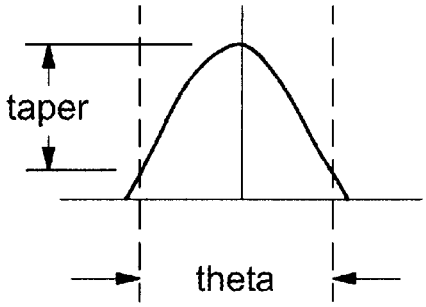
FIG. 4 is a schematic depiction of an exemplary feed pattern for the antenna system of FIG. 2.

In general, the initial curvatures of the main reflector 104 and the sub reflector 102 are determined from a selected aperture energy distribution, such as truncated Gaussian. Certain parameters are selected from which the antenna shapes are incrementally defined. Input parameters include the main reflector midpoint location MRM, sub-reflector midpoint location SRM, and feed center location FC shown in FIG. 3, as well as the reflector size. Additional parameters include feed angle theta and feed taper, which are shown in FIG. 4, and the synthesis interval described below.

Figure 4A:
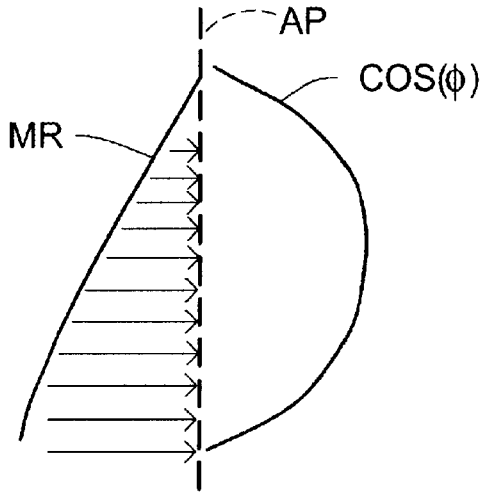
FIG. 4A is a schematic depiction of an exemplary aperture field distribution for the antenna system of FIG. 2.

The initial aperture field distribution is then selected based upon the requirements of an intended application. The initial field distribution can be selected from a wide variety of suitable analytical, i.e., defined by a function, aperture distributions including truncated Gaussian, cosine function, quadratic function, and the like having a constant pedestal. FIG. 4A shows an exemplary first order cosine field distribution from an aperture AP of the main reflector MR.

In general, the shapes of the main and sub reflectors are incrementally defined based upon the desired aperture field distribution and feed pattern using the law of energy conservation, Snell's law, and equal path length requirements (feed to sub reflector to main reflector). As is well known to one of ordinary skill in the art, the ray path that follows Snell's law is the path such that the reflection angle is equal to the incident angle.

The reflector shapes can be modified in relation to the sidelobe requirements for the particular application. More particularly, the reflector shapes can be modified from the analytical function aperture distribution such as the truncated Gaussian, such that the sidelobes track the allowable sidelobe envelope with a predetermined margin. By allowing the sidelobes to be as large as possible, yet less than the maximum allowable sidelobes, the resultant dual reflector antenna has optimal overall efficiency $\eta_r$. That is, the reflector shapes provide the optimal balance between low sidelobes and illumination efficiency.

In addition, a relatively large portion of the energy, e.g., 95–98%, radiated from the feed with a feed angle of about ±45–50 degrees for example, can be captured and efficiently used so as to minimize spillover losses and maximize the overall efficiency.

Figure 5:
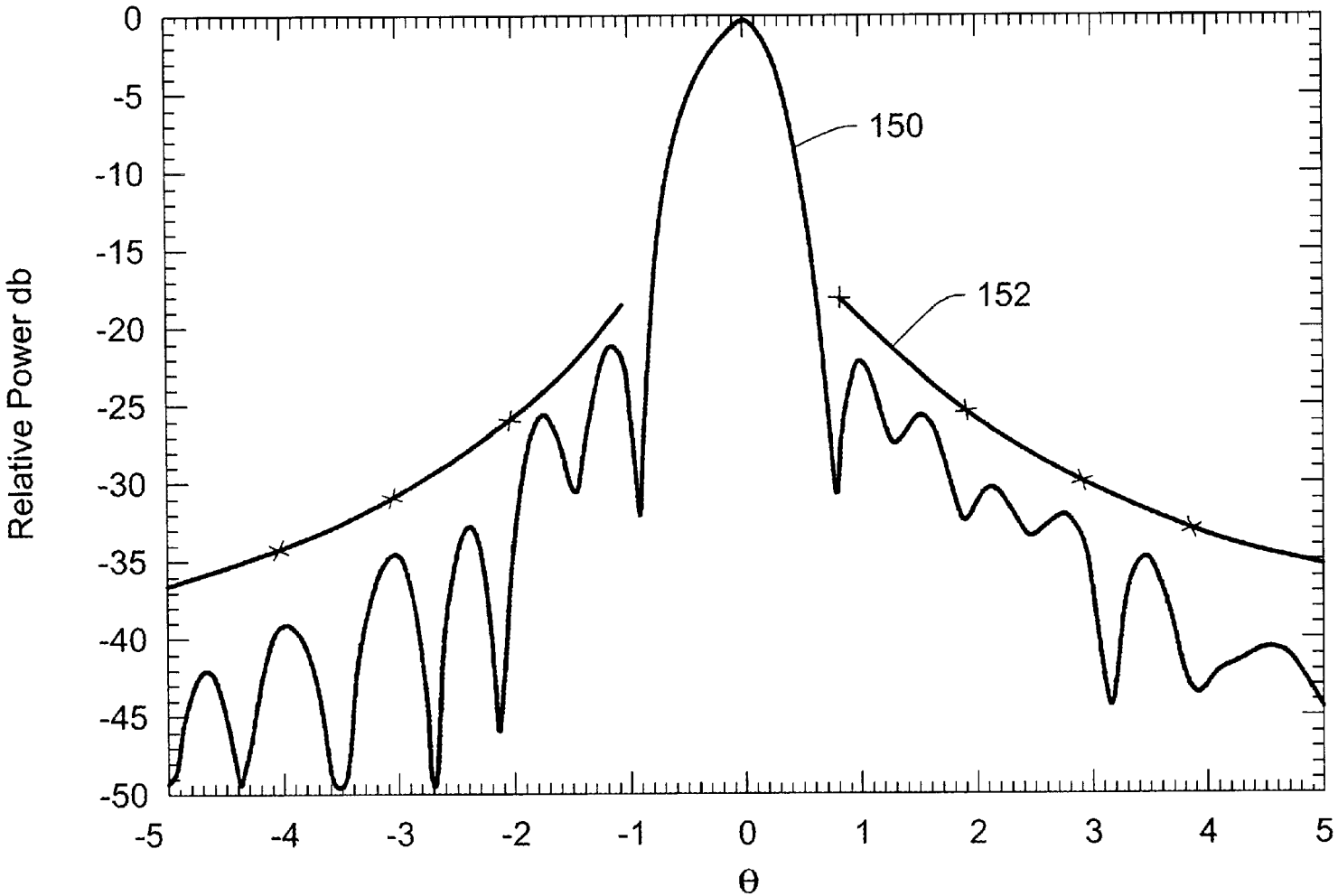
FIG. 5 is a graphical depiction of an exemplary antenna pattern produced by the antenna system of FIG. 2.

FIG. 5 shows an exemplary antenna pattern 150 for a 95 cm main reflector at 30 GHz in an azimuth plane. As can be seen, the pattern 150 tracks a sidelobe envelope 152, which can be 29–25 $\log_{10}$(theta) for example. The pattern sidelobes approach the envelope 152 while remaining underneath. A margin can be built in, which can include production tolerance, to prevent the sidelobes from exceeding the envelope.

This invention can be applied to various antenna sizes as long as the subreflector is "electrically sufficiently large", e.g., in the order of 5 wavelengths or larger. For subreflectors smaller than about 5 wavelengths, the diffraction effect becomes relatively high so that the antenna performance will be degraded significantly. The range of the feed taper is typically from about −15 dB to about −20 dB down, which corresponds to approximately 96% to 99% spillover efficiency. The feed angle ranges can vary widely depending on the desired feed pattern. However, for minimal spillover lobes, angles from about 45° to about 50° half angle have been found optimal. The overall antenna efficiency will depend on the required sidelobe envelope. Efficiencies from about 70% to about 80% for typical commercial sidelobe requirements have been achieved.

Figure 6:
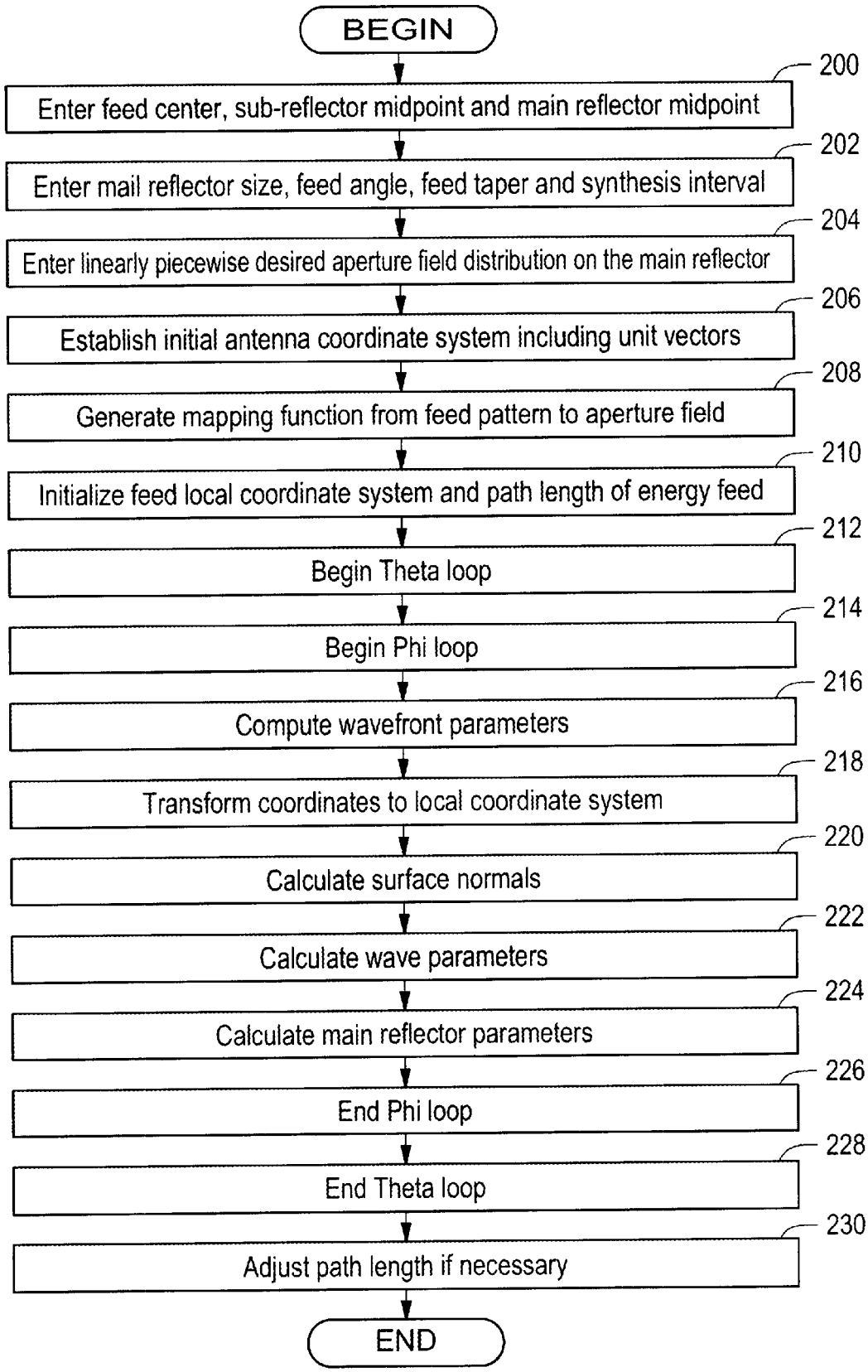
FIG. 6 is a flow diagram showing an exemplary sequence of steps for synthesizing the shapes of the main and sub reflectors in accordance with the present invention.

FIG. 6 shows an exemplary sequence of steps for defining a dual reflector antenna in accordance with the present invention. It is understood that the operator has a rough idea of the size and location of the feed, main reflector and sub reflector of the antenna. In step 200, initial information for the antenna is entered including the feed center, the sub-reflector midpoint, and the main reflector midpoint. In step 202, further information for the antenna is entered including main reflector size, feed angle, feed taper, and synthesis interval. The main and sub reflector surfaces are defined from initial information over a feed angle increment defined by the operator.

In step 204, the operator enters a desired aperture field distribution, such as truncated Gaussian, on the main reflector in a linearly piecewise manner, e.g., incrementally across the main reflector aperture. It is understood that the synthesis interval can vary based upon the degree of linearity of the field distribution, e.g., smaller step sizes near the field distribution peak where the curvature is higher.

Figure 7:
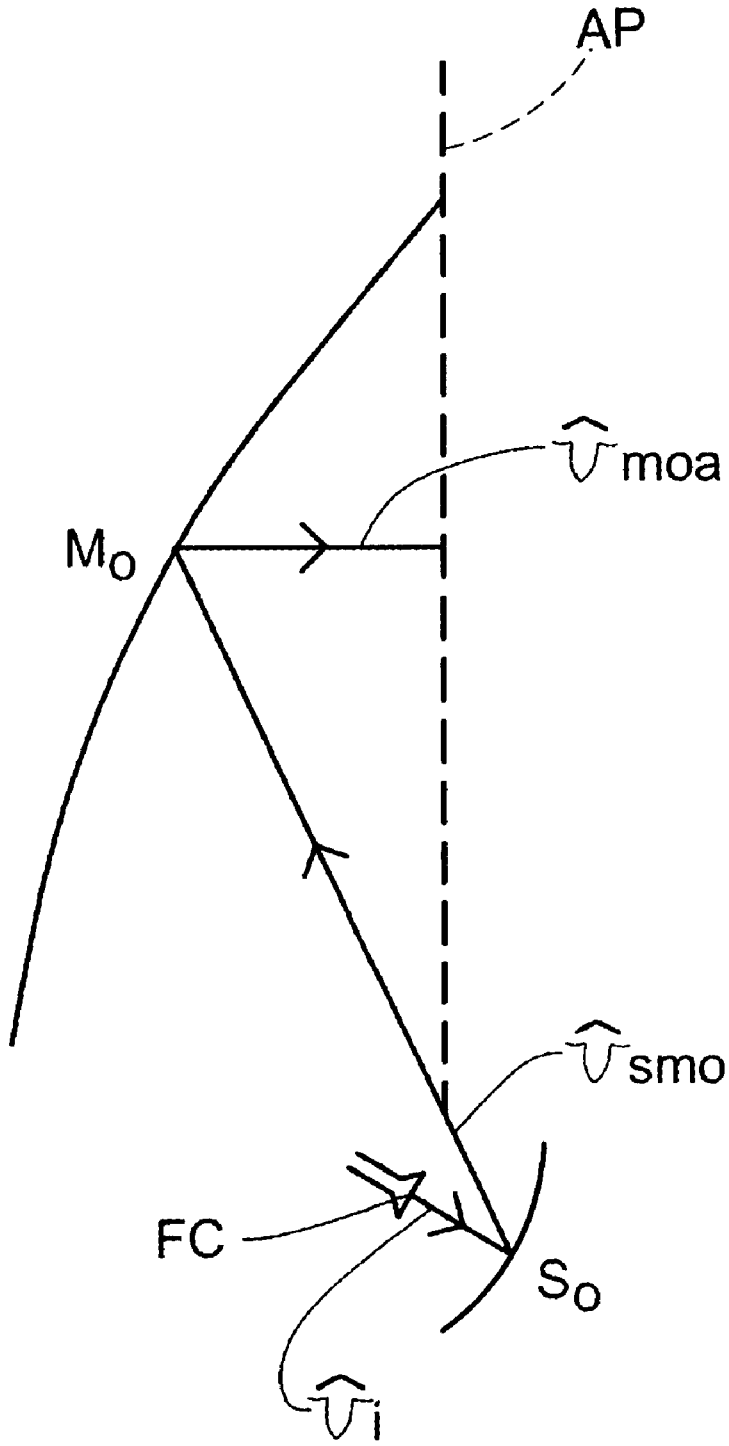
FIG. 7 is a schematic depiction showing unit vectors used to synthesize the reflector shapes in accordance with the present invention.

An initial antenna coordinate system including unit vectors is established in step 206. This local coordinate system is determined by the feed center FC, the sub reflector midpoint $S_0$ and the main reflector midpoint $M_0$. As shown in FIG. 7, a unit vector system can define the initial components as a starting point for the synthesis process. As shown, a first unit vector $\hat{\upsilon}_i$ extends from the feed center FC to the sub reflector midpoint $S_0$, a second unit vector $\hat{\upsilon}_{sm0}$ extends from the sub reflector midpoint $S_0$ to the main reflector midpoint $M_0$, and a third unit vector $\hat{\upsilon}_{moa}$ extends from the main reflector midpoint $M_0$ to the main reflector aperture AP.

Figure 8A:
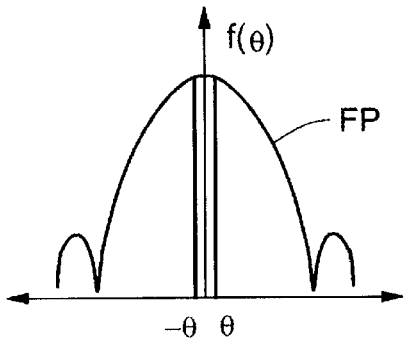
FIG. 8A is a graphical representation of an exemplary feed pattern showing a portion for mapping to the aperture field distribution of FIG. 8B.
Figure 8B:
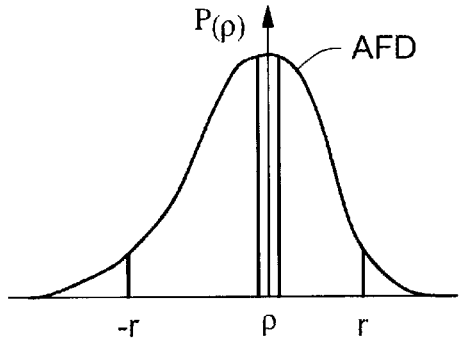
FIG. 8B is a graphical representation of an exemplary aperture field distribution showing a portion for mapping to the feed pattern of FIG. 8A.

Referring again to FIG. 6, in step 208, a mapping function is generated to map the energy between the known feed pattern (f(θ) in FIG. 8A) and the known desired aperture field distribution AFD (ρ(θ) in FIG. 8B). From the laws of conservation of energy, it is known that every incremental portion of the energy from the feed must equal the corresponding portion of the energy at the aperture. In one embodiment, the energy for a given distance ρ from the peak of the aperture field distribution is determined by integrating the selected area AA under the distribution curve AFD. The corresponding feed pattern angle theta having the same energy is then determined. This process continues to provide a mapping function ρ(θ) of the energy between the feed pattern and the aperture field distribution.

Figure 9A:
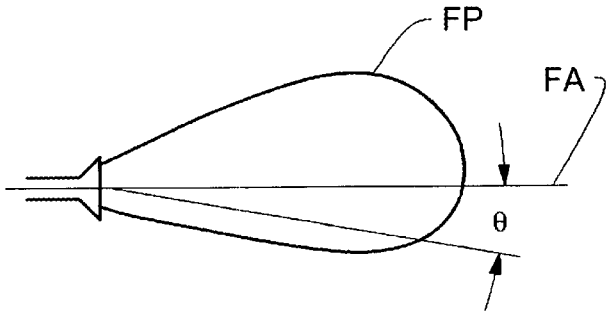
FIG. 9A is a pictorial side view of a feed pattern about a feed axis of an antenna system in accordance with the present invention.
Figure 9B:
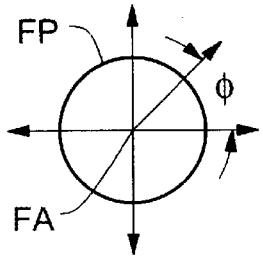
FIG. 9B is a pictorial top view showing an angle of rotation about the feed axis of FIG. 9A.

In step 210, the feed local coordinate system and the total path length of the energy from the feed to the sub reflector to the main reflector aperture is initialized. FIG. 9A is a side view of the feed angle θ and FIG. 9B is a top view of the feed pattern FP showing the angle Φ about the feed pattern. In step 212, a theta angle loop is initiated. As described above, the feed angle is measured from the initial feed axis FA, which is determined by the feed center and the sub reflector midpoint. In step 216, a phi angle is initiated. The phi angle loop provides an incremental 360 degree rotation about the initial feed axis FA.

Figure 10:
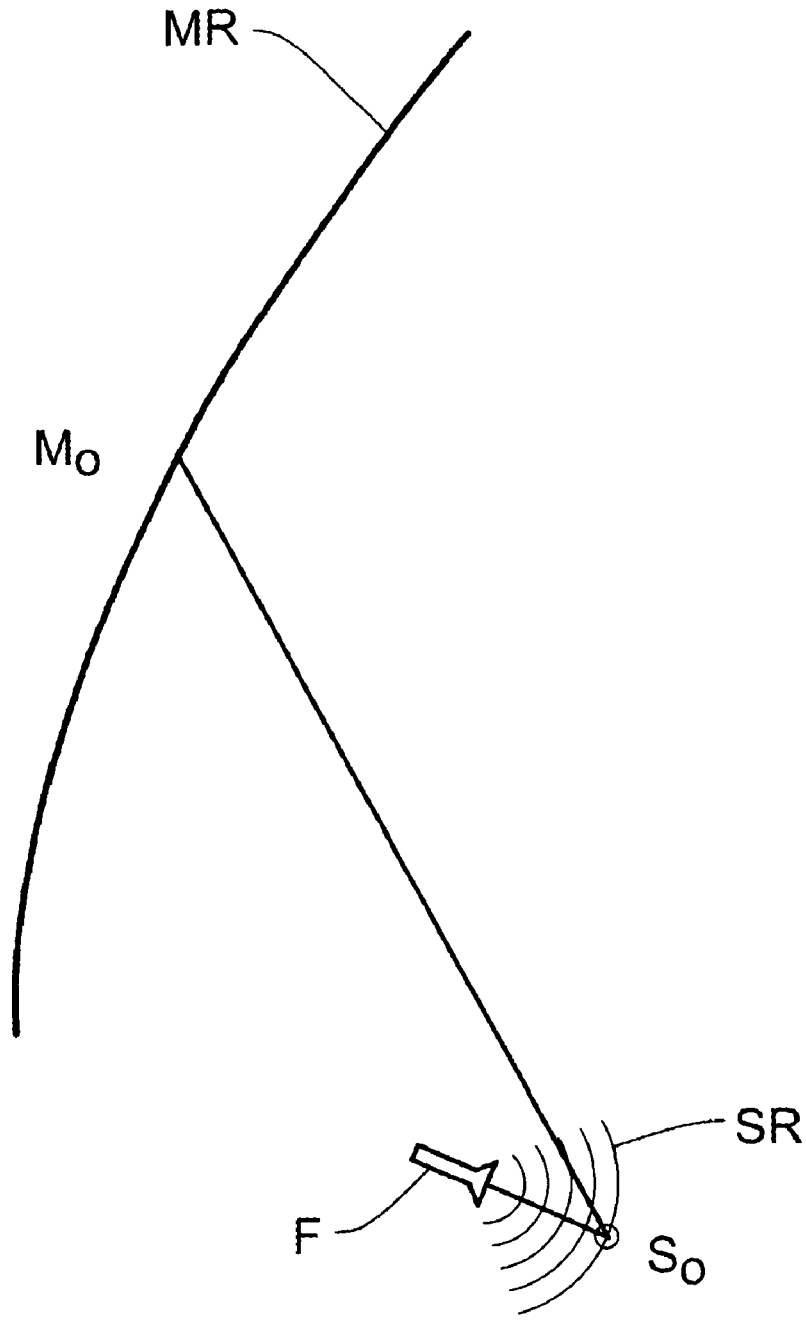
FIG. 10 is a pictorial representation of a spherical wavefront from a point source feed of an antenna system in accordance with the present invention.

In step 216, wavefront parameters of the input ray are computed for later use in finding each reflector surface normal and surface point. More particularly, as shown in FIG. 10, energy from the feed is reflected by the sub reflector SR to the main reflector MR. Defining the feed as a point source, the feed energy has a spherical wavefront. The initial input ray is then defined by two principal radii of curvature, which ride on a plane. Defining wavefront parameters is well known to one of ordinary skill in the art. Since the energy radiated from the feed is a spherical wave, the radius of curvature of the wavefront to the sub reflector corresponds to the distance from the feed F to the sub reflector SR. The curvature is the inverse of the radius. Over the theta and phi loops, the wavefront parameters are used to define surface normals for each point on the main and sub reflectors MR, SR. When using the relatively small increments of the theta and phi loops, the wavefront can be considered local with respect to the surface point currently being synthesized with each previous wavefront being used to find the next point.

In step 218, the coordinates are transformed to the local coordinate system of the wavefront parameters to a global coordinate system on which the reflector surfaces can be defined. In order to find the surface normal vectors, the incident vector and the reflected vector are expressed in the global coordinate system. In step 220, the surface normals are incrementally calculated from the transformed wavefront parameter information starting from the reflector midpoints.

The wave parameters are then calculated in step 222, such as by using so-called floating mapping. As known to one of ordinary skill in the art, floating mapping refers to a well known technique that provides some flexibility with respect to a coordinate system. In one embodiment, the reflected rays off the main reflector to the aperture and the rays off the sub reflector from the feed are calculated from the surface normals using Snell's law. The resultant ray calculations are used to determine the wave parameters between the sub reflector and the main reflector, such as by solving a four by four linear equation that includes the mapping function $\rho(\theta)$. In step 224, the main reflector parameters are then defined by radii of curvature and location. The reflector surfaces are synthesized over the theta and phi angles until the loops end in steps 226 and 228.

In step 230, any necessary path length adjustments are made to correct computational limitations since the path lengths from the feed to the sub reflector to the main reflector must be equal. In one embodiment, a derivative over $d\rho/d\theta$ is used to make adjustments.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A method for shaping reflectors, comprising:

selecting a desired analytical aperture field distribution and a feed pattern from a feed;

defining parameters of the main and sub reflectors;

mapping energy from the feed pattern to the aperture field distribution;

incrementally defining surface normals for each point of the main and sub reflectors;

determining the shape of the main and sub reflectors to provide an aperture field distribution that generates optimal sidelobes under a predetermined sidelobe envelope for maximizing aperture illumination efficiency.

2. The method according to claim 1, further including incrementally determining wavefront parameters of energy from the feed to points on the sub reflector.

3. The method according to claim 2, further including determining wavefront parameters from the points on the sub reflector to corresponding points on the main reflector.

4. The method according to claim 3, further including determining surface normals for the points on the main reflector.

5. The method according to claim 1, further including synthesizing the reflector shapes about a feed angle with respect to a feed axis.

6. The method according to claim 5, further including synthesizing the reflector shapes about a rotation angle about the feed axis for each feed angle.

7. The method according to claim 1, further including adjusting the main reflector shape and/or the sub reflector shape to make equal path lengths from the feed to the sub reflector to the main reflector.

8. The method according to claim 1, further including capturing more than 95 percent of the feed pattern energy.

9. The method according to claim 1, further including capturing from about 95 percent to about 98 percent of the feed pattern energy.

10. The method according to claim 1, further including utilizing a feed angle in the range from about ±45–50 degrees.

11. The method according to claim 1, further including adjusting a synthesis interval based upon the linearity of the analytical aperture field distribution.

12. The method according to claim 1, further including shaping the main reflector and the main reflector to achieve an overall antenna efficiency of greater than about 75 percent while meeting a sidelobe requirement of about 29–25 $\log_{10}\theta$, wherein $\theta$ is the pattern angle measured from antenna boresight.

13. The method according to claim 12, wherein the main reflector corresponds to about a 95 cm Ka-band antenna.

14. The method according to claim 1, further including providing a −15 dB sub reflector edge taper.

15. The method according to claim 1, further including selecting the desired analytical aperture field distribution from the group consisting of truncated Gaussian, cosine, higher order cosines, and quadratic functions.

16. An article of manufacture having main and subreflectors fabricated by the steps of:

selecting a desired analytical aperture field distribution and a feed pattern from a feed;

defining parameters of the main and sub reflectors;

mapping energy from the feed pattern to the aperture field distribution;

incrementally defining surface normals for each point of the main and sub reflectors; and determining the shape of the main and sub reflectors to provide an aperture field distribution that generates optimal sidelobes under a predetermined sidelobe envelope for maximizing aperture illumination efficiency.

* * * * *

UNITED STATES PATENT AND TRADEMARK OFFICE

CERTIFICATE OF CORRECTION

PATENT NO. : 6,603,437 B2
DATED : August 5, 2003
INVENTOR(S) : Yueh-Chi Chang

It is certified that error appears in the above-identified patent and that said Letters Patent is hereby corrected as shown below:

Title page,
Item [57], ABSTRACT,
Line 1, delete “subreflector” and replace with -- sub-reflector --.

Column 1,
Line 23, delete “near in” and replace with -- near-in --.
Line 58, delete “subreflector” and replace with -- sub-reflector --.
Lines 65-66, delete “sub reflector” and replace with -- sub-reflector --.

Column 2,
Line 5, delete “sub reflector” and replace with -- sub-reflector --.
Line 8, delete “an” and replace with -- any --.
Lines 11-12, delete “near in” and replace with -- near-in --.
Lines 34-35, delete “sub reflectors” and replace with -- sub-reflectors --.
Line 61, delete “subreflector” and replace with -- sub-reflector --.
Line 65, delete “sub reflector” and replace with -- sub-reflector --.

Column 3,
Lines 15 and 50, delete “sub reflectors” and replace with -- sub-reflectors --.
Lines 19 and 66-67, delete “sub reflector” and replace with -- sub-reflector --.
Line 49, delete “subreflector” and replace with -- sub-reflector --.

Column 4,
Lines 5, 17, 23, 43, 49, 56, 63 and 64, delete “sub reflector” and replace with -- sub-reflector --.
Line 67, delete “sub reflectors” and replace with -- sub-reflectors --.

Column 5,
Line 20, delete “sub reflectors” and replace with -- sub-reflectors --.
Lines 22-23, 31 and 58, delete “sub reflector” and replace with -- sub-reflector --.
Lines 46, 50 and 51, delete “sub reflectors” and replace with -- sub-reflectors --.

UNITED STATES PATENT AND TRADEMARK OFFICE

CERTIFICATE OF CORRECTION

PATENT NO. : 6,603,437 B2
DATED : August 5, 2003
INVENTOR(S) : Yueh-Chi Chang

It is certified that error appears in the above-identified patent and that said Letters Patent is hereby corrected as shown below:

Column 6,
Lines 3, 15, 16-17 and 38, delete “sub reflector” and replace with -- sub-reflector --.
Lines 43-44, delete “subreflectors” and replace with -- sub-reflectors --.
Lines 43-44, delete “subreflectors” and replace with -- sub-reflectors --.
Lines 47, 51 and 52, delete “sub reflectors” and replace with -- sub-reflectors --.
Line 47, delete “sub reflectors” and replace with -- sub-reflectors --.

Signed and Sealed this

Fourteenth Day of October, 2003

JAMES E. ROGAN
*Director of the United States Patent and Trademark Office*